United States Patent [19]

Veazey

[11] 4,119,747

[45] Oct. 10, 1978

[54] METHOD FOR APPLYING A FINISH TO A TOW

[75] Inventor: Thomas M. Veazey, Decatur, Ala.

[73] Assignee: Monsanto Company, Decatur, Ala.

[21] Appl. No.: 821,263

[22] Filed: Aug. 3, 1977

[51] Int. Cl.[2] ..... B05C 5/00

[52] U.S. Cl. ..... 427/424; 427/434 D; 8/151; 68/6; 68/181 R

[58] Field of Search ..... 19/65 T, 66 T, 66 R; 28/219, 283; 68/6, 181 R; 8/151; 118/325, 314; 427/424

[56] References Cited

U.S. PATENT DOCUMENTS 3,353,380 11/1967 Taylor, Jr. ..... 68/181 R 3,353,381 11/1967 Taylor, Jr. ..... 68/181 R 3,533,252 10/1970 Harris ..... 68/181 R

*Primary Examiner*—Dorsey Newton

*Attorney, Agent, or Firm*—Robert L. Broad, Jr.

[57] ABSTRACT

The method of applying a finish to a tow of filaments, wherein the tow is advanced along a path through a housing having at least two bends in opposite direction to each other and passing a liquid containing a finish along the walls of the housing to the inside corners of the bends. The stream of liquid has a sufficiently high velocity that it clings in layers to the walls of the housing to the inside corners thereof, the bends being sufficiently great that the stream will separate from the walls of the housing and pass through the tow at a high velocity.

3 Claims, 2 Drawing Figures

METHOD FOR APPLYING A FINISH TO A TOW

BACKGROUND OF THE INVENTION

Field of the Invention

This invention relates to methods of applying a finish to tows of filaments.

Prior Art

Finishes are conventionally applied to tows of filaments by passing the tows through an aqueous bath containing the finish. Penetration of the tow by the finish bath is not always good when this method is used.

SUMMARY OF THE INVENTION

The method of applying a finish to a tow of filaments, wherein the tow is advanced along a path through a housing having at least two bends in opposite directions to each other and passing a liquid containing a finish along the walls of the housing to the inside corners of the bends. The velocity of the stream of liquid is such that the liquid clings in a layer to the walls of the housing and the bends of the inside corners of the housing are sufficiently great that the liquid will separate from the walls of the housing at these bends and pass through the tow to apply the finish to the tow.

DETAILED DESCRIPTION OF THE INVENTION

Figure 1:
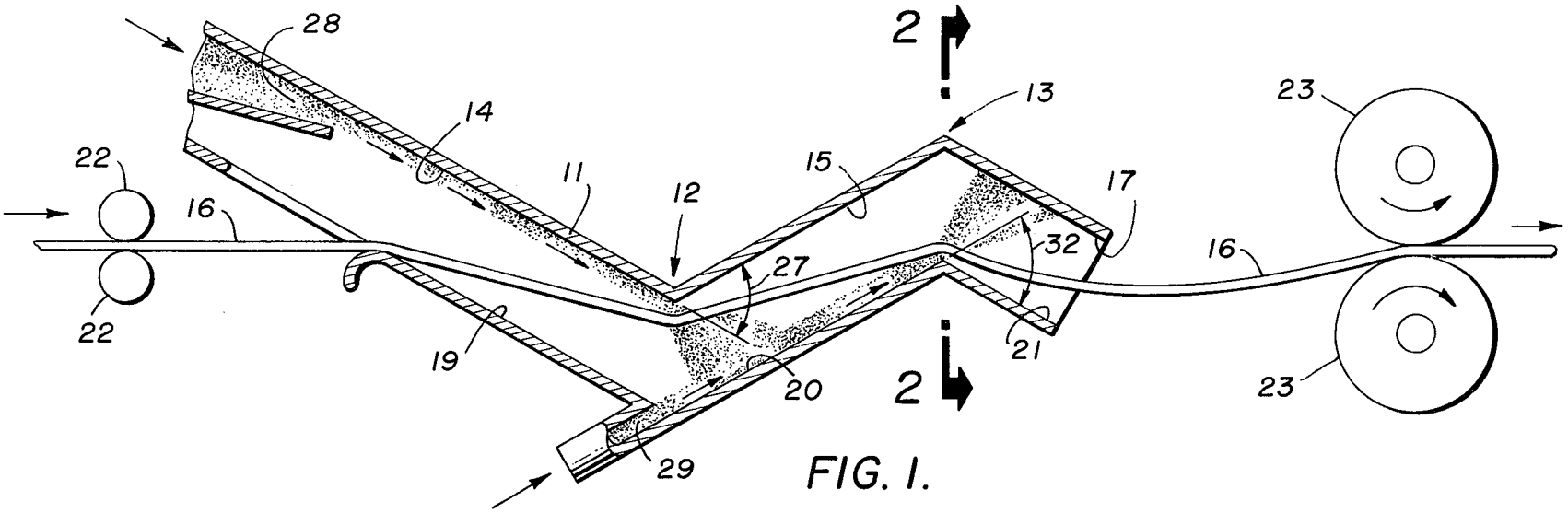
FIG. 1 is a schematic side view of apparatus useful in carrying out the process of the present invention, showing the sawtooth path of the tow through the apparatus.
Figure 2:
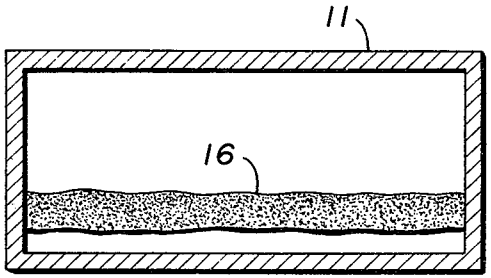
FIG. 2 is a cross-sectional view taken on line 2—2 of FIG. 1 showing the ribbon-like cross-section configuration of the tow passing through the apparatus.

FIGS. 1 and 2 schematically show apparatus suitable for carrying out process of the present invention. This apparatus consists of a housing 11 having a rectangular cross-section as shown in FIG. 2 and at least two bends 12 and 13, the bend 12 being upward and the bend 13 being downward. The cross-section configuration of the housing 11 is such that a tow 16 in the form of the flat ribbon of filaments passes through the housing along a path having a sawtooth figuration when viewed from the side, as illustrated in FIG. 1.

The upper limits of the tow path are defined by the downwardly-facing inner surface of the upper wall of the housing 11. This downwardly facing inner surface includes a guide surface 14, a "downstream" surface 15 and an exit surface 17 connected in series in the order enumerated. The lower limits of the tow path are defined by the upwardly-facing inner surface of the lower wall of the housing 11, this wall being made up of an inlet surface 19, a guide surface 20, and a "downstream" surface 21. The tow 16 is fed into the housing 11 by a pair of feed rolls 22 and is withdrawn from the housing by a pair of take-up rolls 23. The rolls 22 and 23 are driven at speeds such that the tension on the tow passing through the housing 11 is relatively low.

The housing 11 is provided with a first liquid nozzle 28 having a configuration and being positioned such that this nozzle forces a stream of liquid, preferably water, containing a conventional fiber finish in a flat sheet along the guide surface 14. The velocity of this stream is sufficiently high that the Coanda effect will cause this liquid to cling in a thin layer to the guide surface 14 until it reaches the inside corner of the bend 12. This layer of moving liquid will "lubricate" the guide surface 14 for the passage of the tow 16. The downstream (in a sense that it is downstream of the guide surface 14) surface 15 intersects the surface 14 at an angle 27 which is sufficiently great that the layer of liquid will separate from the guide surface 14 and impinge upon and pass through the tow 16. If the angle 27 is less than about 45° or the inside corner of the bend 12 is rounded too much, the Coanda effect will cause the layer of liquid to flow around this corner and along the downstream surface 15, thereby defeating the purpose of the process.

The housing 11 is provided with a second liquid nozzle 29, positioned as shown in FIG. 1, to direct a layer of liquid along the guide surface 20 to the inside corner of the bend 13. The velocity of the liquid is sufficiently high that the Coanda effect will cause the liquid to flow along the surface 20 in a thin layer to the inside corner of the bend 13. The guide surface 20 intersects the downstream surface 21 at an angle 32 which is sufficiently great that the layer of liquid will separate from the wall of the housing 11 and pass through the tow at the bend 13 in the housing. The angle 32 should be at least about 45° and the inside corner of the bend 13 should be relatively sharp to prevent the liquid layer from flowing around the inside corner of the bend 13 and along the downstream surface 21.

In operation, the tow 16 is advanced to the housing 11by the rolls 22. Streams of liquid, preferably water, in layer or sheet configurations will flow from the nozzles 28 and 29 down the guide surfaces 14 and 20, respectively, to the inside corners of the bends 12 and 13. The liquid contains a conventional fiber finish. The Coanda effect will cause these streams to cling to the surfaces 14 and 20 in thin layers. When these streams reach the inside corners of the bends 12 and 13, they separate from these surfaces and pass through the tow to thoroughly wash the tow. Because of the fact that the liquid is impinging on the tow in a thin layer, tow penetration is excellent. Good penetration of the tow is achieved to uniformly apply finish to all of the filaments in the tow.

What is claimed is:

1. The method of applying a fiber finish to a tow of filaments, comprising:

a. advancing the tow along a path through a housing, said path having at least two bends each having an inside and an outside corner, said bends being in opposite directions to each other in such a manner that said path has a sawtooth configuration; and b. passing a liquid containing a fiber finish along the walls of the housing leading to the inside corners of the bends, the liquid having a velocity such that said liquid clings in layers to the walls of the housing to said inside corners, the bends of said inside corners being sufficiently great that said liquid separates from said walls and passes through the tow at said inside corners.

2. The method of claim 1 wherein said inside corners are bent at an angle of at least about 45°.

3. The method of claim 2 wherein the liquid is water.

* * * * *